US006694031B2

(12) United States Patent
Paritsky et al.

(10) Patent No.: US 6,694,031 B2
(45) Date of Patent: Feb. 17, 2004

(54) OPTICAL MICROPHONE/SENSORS

(75) Inventors: Alexander Paritsky, Modiin (IL); Alexander Kots, Ashdod (IL)

(73) Assignee: Phone-Or Ltd., Or-Yehuda (IL)

( * ) Notice: Subject to any disclaimer, the term of this patent is extended or adjusted under 35 U.S.C. 154(b) by 0 days.

(21) Appl. No.: 09/960,533

(22) Filed: Sep. 21, 2001

(65) Prior Publication Data

US 2002/0094096 A1 Jul. 18, 2002

(30) Foreign Application Priority Data

Sep. 21, 2000 (IL) ..... 138611

(51) Int. Cl.[7] ..... H04R 25/00
(52) U.S. Cl. ..... 381/172
(58) Field of Search ..... 381/172; 359/149, 359/150; 356/4.01, 373

(56) References Cited

U.S. PATENT DOCUMENTS 5,290,169 A 3/1994 Friedman et al.
5,771,091 A * 6/1998 Paritsky et al. ..... 356/4.01
6,091,497 A * 7/2000 Paritsky et al. ..... 356/373

FOREIGN PATENT DOCUMENTS

EP 0 866 313 A1 9/1998

* cited by examiner

*Primary Examiner*—Sinh Tran
(74) *Attorney, Agent, or Firm*—William Michael Hynes; Townsend and Townsend and Crew LLP

(57) ABSTRACT

The invention provides a head for an optical microphone/sensor, including first and second light guides; the first light guide being coupled at an input end to a source of light and having an output end portion for transmitting light onto a membrane; the second light guide having an input end portion for receiving light reflected from the membrane and an output end coupled to a photodetector; the output end and input end portions each having an upper face and side surfaces and being disposed in close proximity to each other and optically separated along adjacent surfaces; characterized in that in order to utilize maximum light energy transmitted through the light guides by the light source, reflected by the membrane and received by the photodetector, at least one of the faces or surfaces is configured to extend along one or more planes which differ from the plane including the axes of the transmission of the light energy emitted from the light source and received by the photodetector.

4 Claims, 2 Drawing Sheets

OPTICAL MICROPHONE/SENSORS

FIELD OF THE INVENTION

The present invention relates to optical microphone/sensors.

BACKGROUND OF THE INVENTION

Several different types of optical microphone/sensors have been developed. One of these uses optical fibers and optical fiber connectors to connect between a light source and a photodetector and the optical fibers at one of their ends and between the fibers and an optical head situated near an acoustical membrane at their other ends. These microphones, of high quality, are expensive due to the high prices of optical fiber and optical connectors, as well as the high cost of the technological process used in their production.

Another type of optical microphone utilizes integral construction, wherein the source of light and the photodetector constitute part of the optical head and there are no optical connectors and optical fibers. The optical head is produced by molding. Such optical microphones are of relatively low cost, compared to that of common electric microphones. Although these microphones possess specific advantageous characteristics, they have a disadvantage in comparison with optical fiber microphones: they are sensitive to radio frequency interference (RFI).

The problem of RFI in microphones becomes even more acute in cellular telephones, as the size of such devices is diminished. Due to the fact that a telephone microphone is distant from the speaker's mouth, its acoustic characteristics are declining.

In order to overcome this problem, in for example cellular telephones it is required to bring the microphone closer to the user's mouth, namely, in this instrument to locate the microphone at the telephone flipper and, by doing so, to bring the microphone closer to the mouth during use.

RFI becomes the main problem in cellular telephones or like apparatus when, for example, the microphone is distant from the telephone apparatus and the connection lines between the microphone and the apparatus become long enough, e.g., several centimeters. In such a case, the RFI value becomes so strong that the use of a distantly located microphone becomes impossible. This phenomenon is typical of electric microphones and, in part, also to integral optical microphones.

DISCLOSURE OF THE INVENTION

It is therefore a broad object of the present invention to improve the sensitivity, as well as the acoustic and other characteristics of an optical microphone/sensor.

It is a further object of the present invention to provide a low-cost optical microphone with no electrical connections or lines between the microphone and the device to which it is connected, and that is not susceptible to RFI.

According to the invention, there is therefore provided a head for an optical microphone/sensor, including first and second light guides, said first light guide being coupled at an input end to a source of light and having an output end portion for transmitting light onto a membrane, said second light guide having an input end portion for receiving light reflected from said membrane and an output end coupled to a photodetector, said output end and input end portions each having an upper face and side surfaces and being disposed in close proximity to each other and optically separated along adjacent surfaces, characterized in that in order to utilize maximum light energy transmitted through the light guides by said light source, reflected by said membrane and received by said photodetector, at least one of said faces or surfaces is configured to extend along one or more planes which differ from the plane including the axes of the transmission of the light energy emitted from said light source and received by said photodetector.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a cross-sectional view of an optical microphone/sensor according to the present invention;

FIGS. 2 to 5 are cross-sectional views of three possible embodiments of optical heads for optical microphones according to the present invention;

FIGS. 6 to 8 are cross-sectional views of three different configurations of light guides according to the present invention, and FIGS. 9 to 14 illustrate different embodiments of the optical microphone/sensors, utilized with different devices.

DETAILED DESCRIPTION

Figure 1:
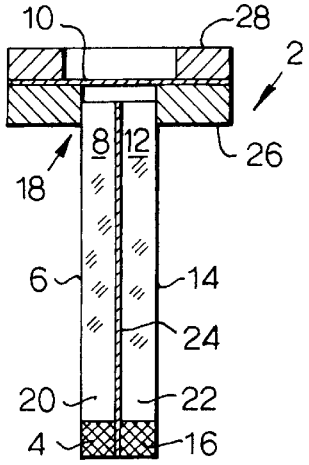

There is shown in FIG. 1 an optical microphone 2, including a light source 4 producing light energy which is transmitted via guide 6 to an optical head portion 8. where it illuminates a membrane 10. The light is reflected back to an optical head portion 12 and transmitted via light guide 14 to a photodetector 16. Portions 8 and 12 comprise an optical head 18, constructed to provide improved optical matching between the light guides and head portions 8 and 12 and the position of membrane 10. The other end portions 20, 22 of light guides 6 and 14 are adapted for improved optical matching between the light source 4 and light guide 6 on the one hand, and between light guide 14 and photodetector 16 on the other hand.

Light guides 6 and 14 may be made of glass, plastic, or any other material transparent to light. If the light guides are made of ordinary optical fibers of glass or plastic, their cladding is used to enclose all of the light energy inside the guides. If the guides are made by molding of transparent material, their surfaces have to be covered before or after molding by an opaque material. Alternatively, an opaque partition 24 is disposed between light guides 6 and 14 for producing optical separation between the guides.

Membrane 10 is placed at a specific distance from the optical head 18. This distance may be determined and affixed by means of a spacer 26 and a ring 28. A change of acoustical pressure on membrane 10 changes its position. Light energy reflected by the membrane 10 into light guide 14 is transmitted to photodetector 16, which measures different values of incoming light energy and correspondingly produces different values of output signals.

Figure 2:
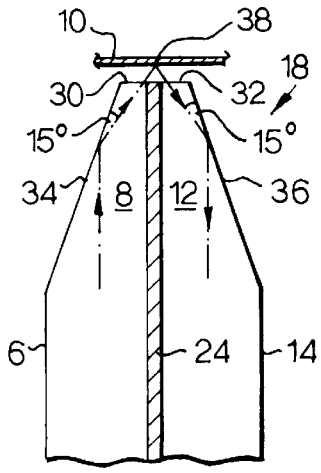

FIG. 2 is an enlarged, cross-sectional view of one possible embodiment of an optical head 18. Two light guides 6, 14 are placed in the closest possible proximity to one another and are separated from each other only by the opaque partition 24, which prevents light from passing directly from one guide to the other without being reflected by membrane 10.

The end portions 8 and 12 of both light guides possess a specific geometry: The top faces 30, 32 of the light guides are perpendicular to the axis of the light guides, and the upper side surfaces 34, 36 are cut off at an angle of 15 degrees to the axis of the light guides.

A light beam that is transmitted alone the axis of the light guide 6 impinges upon surface 34 at an angle of 15 degrees, is reflected by it through face 30, impinges on membrane 10 and is reflected therefrom towards the face 32 of light guide 14, impinges on and is reflected from surface 36 at an angle of 15 degrees, and proceeds in the guide 14 to the photodetector 16 (not shown in FIG. 2). This structure enables the concentration of the light energy transmitted by light guide 6 upon the central area or point 38 on membrane 10.

Figure 3:
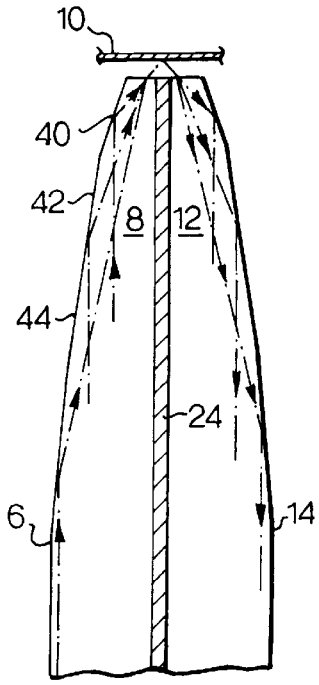

There is shown in FIG. 3 a cross-section of another possible embodiment of the optical head 18. According to this embodiment, the sides of the optical lead 18 of the two light guides 6, 14 are cut or produced with three facets 40, 42, 44, facet 40 with an angle of 15 degrees, facet 42 with an angle of 10 degrees, and facet 44 with an angle of 5 degrees. This construction gives the largest concentration of light energy upon membrane 10.

Figure 4:
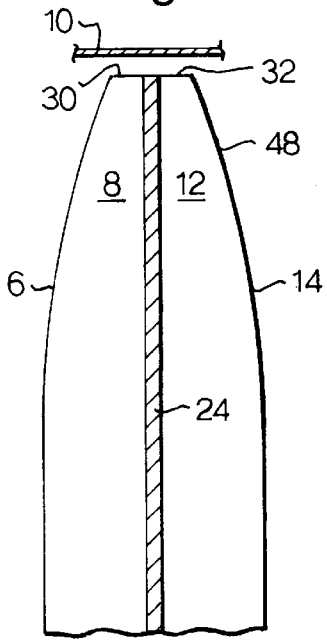

A modification of the embodiment of FIG. 3 is shown in FIG. 4. Instead of producing three distinctive facets 40, 42, 44, the head is configured to have a contiguous, gradually curved surface 48, forming a hyperbolic curve. The outer surfaces of light guides 6, 14 gradually vary from 15 degrees relative to the axis of the guides at the top faces 30, 32, to 0 degrees cut off at the lower portions of the outer surface of the guides.

Figure 5:
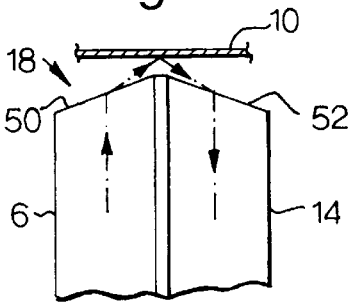

FIG. 5 illustrates an enlarged portion of another embodiment of an optical head 18. Both light guides 6 and 14 are cut off at their faces 50, 52 at an angle of about 65–80 degrees to the axis of the guides. The exact angle value depends on the refractive index of the light guide material.

Figure 7:
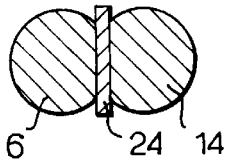
Figure 6:
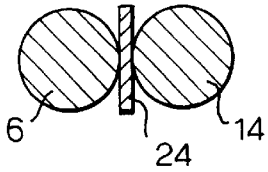
Figure 8:
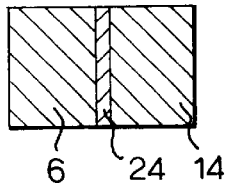

Referring to FIGS. 6 to 8, there are shown cross-sectional views of several usable configurations for light guides 6, 14 and their relative disposition to each other. FIG. 6 depicts a cylindrical cross-section of each of the guides 6, 14, separated by an opaque partition 24. FIG. 7 illustrates two guides 6, 14 configured as semi-cylinders in cross-section. The planar, longitudinal surfaces make a better contact with partition 24. The guides may also have an elliptical cross-section (not shown). A square configuration of guides 6, 14 is shown in FIG. 8.

Figure 9:
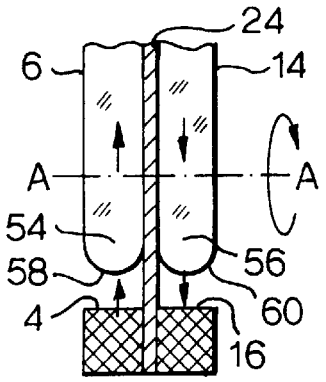

Turning now to FIG. 9, there are shown lower end portions 54, 56 of light guides 6, 14. The end portions 54, 56 are placed in close proximity to the light source 4 and photodetector 16. The light guides 6, 14, light source 4 and photodetector 16 are separated from each other by an opaque partition 24. The edges 58, 60 of the end portions of both light guides have spherical contours. These spherical edges act as lenses which concentrate light from light source 4 into the light guide 6 and from light guide 14 to photodetector 16.

Figure 10:
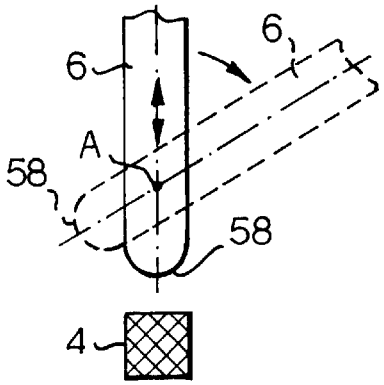

In order to facilitate the swivelling of the optical microphone mounted in, e.g., the flipper of a cellular telephone, the light guides 6, 14 are coupled along axis A—A to the telephone, thus enabling movement of the guides relative to light source 4 and photodetector 16, as shown by the broken line in FIG. 10. This is one possible construction of a cellular telephone flipper having an optical microphone coupled to it.

Figure 11:
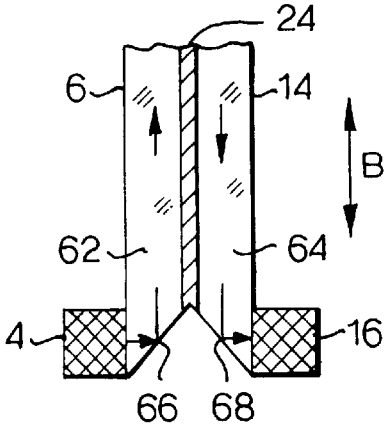
Figure 12:
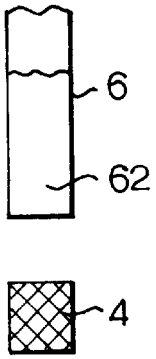

Another possible way of coupling between light source 4, photodetector 16 and the light guides 6, 14 is shown in FIGS. 11 and 12. The end portions 62, 64 of the light guides 6, 14 are cut at an angle and are furnished with reflective material, such as mirrors 66, 68 for reflecting light from light source 4 into light guide 6 and from light guide 14 to photodetector 16. The opaque partition 24 separates the guides. This embodiment may be used with, e.g., a linearly sliding cellular telephone flipper, as indicated by arrow B. Light guides 6, 14 slide along in the direction of arrow B together with the flipper. In a first position (FIG. 11), the end portions 62, 64 are in optical contact with light source 4 and photodetector 16; in their second position (FIG. 12), the end portions are removed from that optical contact.

Figure 13:
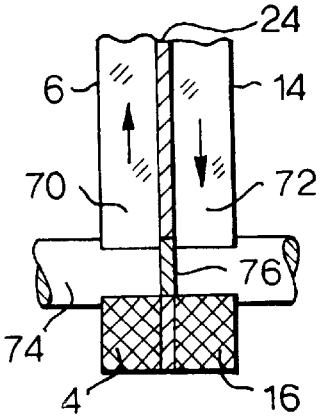
Figure 14:
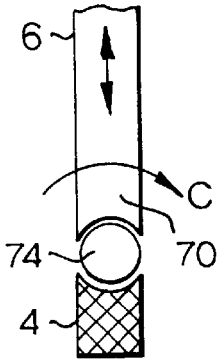

A further possible embodiment for operationally connecting the optical microphone to a cellular telephone or any other apparatus, is shown in FIGS. 13 and 14. The lower end portions 70, 72 of light guides 6, 14 are optically and mechanically coupled with a shaft 74. Shaft 74 is made of transparent material that may be provided with a partition 76 made of opaque material and in alignment with partition 24 between the two optical light guides and the light source and photodetector. Shaft 74 is used for rotating a cellular telephone flipper in order to open and close it. It is also used as a lens for both optical light guides. The cylindrical shape of shaft 74 is suitable for focusing light from the light source 4 into optical light guide 6 and from light guide 14 into photodetector 16.

FIG. 14 shows the side view of the structure of FIG. 13. Arrow C indicates the direction of movement of the flipper and the light guides. The rotation is made about the axis of the shaft.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A head for an optical microphone/sensor including:

first and second light guides having side-by-side light paths including parallel axes of transmission;

said first light guide being coupled at an input end to a source of light, having an output end portion for transmitting light onto a reflecting membrane, and a first light path segment parallel to a first axes for the transmission of light between the light source and the output end portion;

said second light guide having an input end portion for receiving light reflected from said membrane, an output end coupled to a photodetector, and, a second light path segment parallel to a second axes for the transmission of light between the input end portion and the output end, the second axes parallel to the first axes;

said output end and input end portions each having an upper face and side surfaces and being disposed in close proximity to each other and optically separated along adjacent surfaces;

at least one of said faces or surfaces is configured to extend along one or more planes which respectively are not normal or parallel to the plane including the parallel first and second axes for the transmission of the light energy to respectively diffract or reflect light upon the membrane to reflect light between the upper face and side surfaces from the first light guide to the second light guide;

whereby increased light energy is transmitted through the light guides by said light source, reflected by said membrane and received by said photodetector.

2. The head for an optical microphone/sensor as claimed in claim 1, wherein:

said faces or surfaces extend along a plane having an angle calculated to respectively diffract or reflect with respect to the index of refraction of the material of which the light guides are made.

3. The head for an optical microphone/sensor as claimed in claim 1, wherein:

said faces are configured to assume an angle of between 65 and 80 degrees with respect to a plane nominal to said axis.

4. The head for an optical microphone/sensor as claimed in claim 1, further comprising:

an opaque partition is interposed between said light guides.

* * * * *